United States Patent [19]

Schorfheide

[11] 4,243,519

[45] Jan. 6, 1981

[54] HYDROREFINING PROCESS

[75] Inventor: James J. Schorfheide, Baton Rouge, La.

[73] Assignee: Exxon Research & Engineering Co., Florham Park, N.J.

[21] Appl. No.: 12,217

[22] Filed: Feb. 14, 1979

[51] Int. Cl.[3] ..... C10G 65/04; C10G 65/06

[52] U.S. Cl. ..... 208/210; 208/57; 208/58; 208/59

[58] Field of Search ..... 208/210, 57–59

[56] References Cited

U.S. PATENT DOCUMENTS

| | | | |
|---|---|---|---|
| 2,952,626 | 9/1960 | Kelley et al. | 208/210 |
| 3,349,027 | 10/1967 | Carr et al. | 208/210 |
| 3,492,220 | 1/1970 | Lempert et al. | 208/210 |
| 3,717,571 | 2/1973 | Schulman | 208/210 |
| 3,809,644 | 5/1974 | Johnson et al. | 208/210 |
| 3,847,799 | 11/1974 | Munro | 208/210 |
| 3,884,797 | 5/1975 | Alley, Jr. et al. | 208/210 |
| 3,900,390 | 8/1975 | Adams et al. | 208/210 |
| 4,016,069 | 4/1977 | Christman et al. | 208/210 |
| 4,145,276 | 3/1979 | Cosyns et al. | 208/57 |
| 4,159,935 | 7/1979 | Scott | 208/58 X |

FOREIGN PATENT DOCUMENTS

| | | | |
|---|---|---|---|
| 749332 | 12/1966 | Canada | 208/210 |
| 901332 | 7/1962 | United Kingdom | 208/210 |

*Primary Examiner*—Delbert E. Gantz
*Assistant Examiner*—G. E. Schmitkons
*Attorney, Agent, or Firm*—Marthe L. Gibbons

[57] ABSTRACT

A two-stage naphtha hydrorefining process is provided with interstage removal of hydrogen sulfide and light gaseous hydrocarbons. Fresh hydrogen-containing treat gas is introduced only into the second hydrorefining stage and the hydrogen-containing gaseous effluent of the second hydrorefining stage is recycled to the first hydrorefining stage.

13 Claims, 2 Drawing Figures

HYDROREFINING PROCESS

BACKGROUND OF THE INVENTION

1. Field of the Invention

This invention relates to a two-stage naphtha hydrorefining process.

2. Description of the Prior Art

Hydrorefining is a well known process for upgrading a variety of hydrocarbon fractions. Naphtha fractions are subjected to hydrorefining by treating with hydrogen and a hydrorefining catalyst to remove sulfur and nitrogenous compounds which may adversely affect the catalyst used in subsequent treating processes, such as for example, reforming processes. Deep levels of desulfurization, such as those required to produce reforming feeds for multimetallic catalysts are difficult to accomplish in conventional hydrotreating processes.

It is known to presulfide hydrorefining catalysts prior to the hydrorefining step.

A process is known for hydrotreating heavy mineral oils in two stages. The gaseous effluent from the first stage is scrubbed to remove ammonia, light hydrocarbons and hydrogen sulfide. Fresh hydrogen is introduced into the system only at the inlet to the second hydrotreating stage. See U.S. Pat. No. 3,717,571.

A process is known for hydrodesulfurizing a heavy oil. The chargestock is reacted with impure hydrogen gas in a first stage, hydrogen sulfide is removed from the vapor phase first stage effluent, make-up hydrogen is added prior to the second hydrodesulfurization stage. The treat gas from the second stage is recycled to the first stage without removal of hydrogen sulfide. See U.S. Pat. No. 3,847,799.

A multistage hydrodesulfurization process for heavy oils is known in which high purity make-up hydrogen is introduced into the final reaction zone only. See U.S. Pat. No. 3,809,644.

A process is known for hydrotreating residual crude oil in two stages. Fresh hydrogen is fed to the second stage. Hydrogen is recovered from the effluent of the second stage and recycled to the first stage. See U.S. Pat. No. 3,900,390.

A two-stage hydrorefining process for desulfurization of naphtha is known in which hydrogen sulfide and light hydrocarbon gases are removed between stages. The second stage catalyst initially is a non-sulfided catalyst. See U.S. Pat. No. 3,884,797.

It has now been found that a high level of desulfurization of naptha can be obtained in a two-stage hydrorefining process wherein the flow of hydrogen treat gas is integrated in a specific manner.

SUMMARY OF THE INVENTION

In accordance with the invention there is provided a naphtha hydrorefining process which comprises:

(a) contacting a sulfur-containing naphtha feed in a first hydrorefining stage with a hydrorefining catalyst and with a hydrogen-containing gas recycled from step (d) at hydrorefining conditions to produce a first hydrorefining stage effluent comprising a partially desulfurized normally liquid naphtha product and a gaseous product comprising hydrogen and hydrogen sulfide;

(b) separating at least a portion of the hydrogen sulfide from said first hydrorefining stage effluent;

(c) contacting at least a portion of the first hydrorefining stage effluent resulting from step (b) in a second hydrorefining stage at hydrorefining conditions with added fresh hydrogen in the presence of a sulfided hydrorefining catalyst to produce a second stage hydrorefining effluent comprising a normally liquid naphtha having a decreased sulfur content relative to said partially desulfurized naphtha and a hydrogen-containing gas comprising hydrogen sulfide, and (d) recycling at least a portion of the hydrogen-containing gas of step (c) to said first hydrorefining stage.

DESCRIPTION OF THE PREFERRED EMBODIMENTS

The preferred embodiments will be described with reference to the accompanying drawing.

Figure 1:
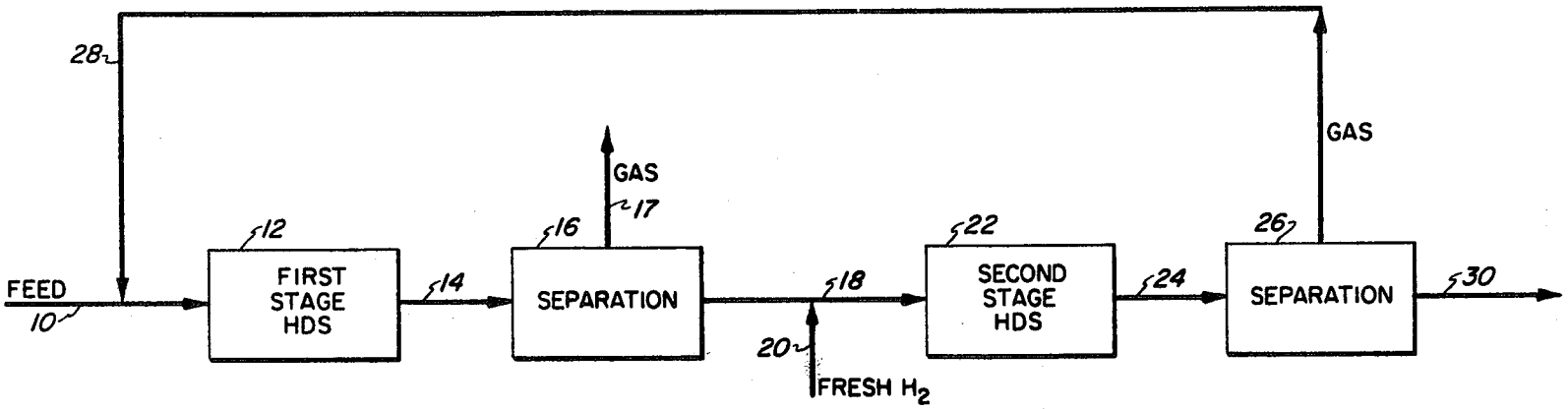
FIG. 1 is a schematic flow plan of one embodiment of the invention.

Referring to FIG. 1, a sulfur containing naphtha feed carried in line 10 mixed with a recycled hydrogen-containing gas from line 28 is introduced into a first hydrorefining stage 12. The term "naphtha" is used herein to refer to a mixture of hydrocarbons boiling (at atmospheric pressure) in the range of about $C_5$ to about 430° F. Preferably, the naphtha feed is an olefin-containing naphtha, such as a naphtha produced by a thermal or catalytic cracking process (cracked naphtha); naphtha produced by a coking process (coker naphtha); naphtha produced by a steam cracking process (steam cracked naphtha) or mixtures thereof. Typically, the naphtha feed comprises a mixture of one or more of an olefinic naphtha together with a non-olefinic naphtha, such as, for example, a virgin naphtha. The olefin-containing naphtha feedstocks comprise at least about 5 volume percent, preferably at least 10 volume percent olefins based on the total feedstock. Generally, such feeds contain from about 0.01 to about 0.60 weight percent sulfur. The first hydrorefining zone is maintained at a temperature ranging from about 400° to about 800° F., preferably from about 500° to about 700° F., a pressure ranging from about 50 to about 2000 psig, preferably from about 150 to about 800 psig, a feed rate of about 0.1 to 10 volumes of feed per volume of catalyst per hour (V/Hr/V) and a hydrogen rate of about 200 to 10,000 standard cubic feet of hydrogen per barrel of naphtha feed. A conventional hydrorefining catalyst is present in the first hydrorefining stage. The catalyst may be maintained in a fixed bed, fluid bed, ebullating bed, moving bed, etc. Suitable hydrorefining catalysts may be any of the conventional hydrorefining catalysts. Generally, these catalysts comprise a hydrogenation component such as a metal, metal oxide or metal sulfide of a Group IVB and a Group VIII non-noble metal of the Periodic Table of Elements on a suitable support, such as, for example cobalt-molybdenum or nickel-molybdenum on a predominantly alumina support which may further comprise minor amounts of silica or other refractory oxides. The Periodic Table referred to herein is given in *Handbook of Chemistry and Physics*, published by the Chemical Rubber Publishing Company, Cleveland, Ohio 45th Edition, 1964. The oxide catalysts are preferably sulfided prior to use in a conventional manner. The first stage hydrorefining reaction is conducted for a time sufficient to produce a partially desulfurized naphtha product. Preferably, the reaction is conducted for a time sufficient to produce a partial desulfurization level ranging from about 90 to about 99 weight percent relative to the naphtha feed sulfur. The first hydrorefining stage effluent comprises a partially desulfurized naphtha product, and a gaseous product including hydrogen sulfide, light hydrocarbon gases such as $C_1$ to $C_3$, hydrogen, etc. The first hydrorefining stage effluent is passed via line 14 to a separation zone 16 where the normally liquid partially desulfurized naphtha is separated from the gaseous product by methods well known in the art. The separation zone may be one or more stages of separation. For the purpose of the present invention, it would not be necessary to remove all of the gaseous product from the first hydrorefining stage effluent product provided that at least a portion, preferably a major portion of the hydrogen-sulfide is removed and preferably also that the light hydrocarbon gases are removed from the first stage effluent. At least a portion of the partially disulfurized naphtha from which the gaseous product has been separated is passed via line 18 to a second hydrorefining stage 22. If desired, a portion of the partially desulfurized naphtha product of the first stage may be withdrawn from line 18. Optionally, additional sulfur-containing naphtha may be introduced into line 18 prior to passing the partially desulfurized first stage naphtha product to the second hydrorefining stage. The added sulfur-containing naphtha may be olefinic or non-olefinic and may comprise as much sulfur as the initial feed or less sulfur than the initial feed. Preferably, the additional sulfur-containing naphtha comprises less sulfur and less olefins than the initial feed of the first hydrorefining stage. Fresh hydrogen-containing treat gas is passed via line 20 into the partially desulfurized naphtha at the inlet of the second hydrorefining stage. The term "fresh hydrogen-containing treat gas" is used herein to designate a substantially pure hydrogen or a hydrogen-containing gas comprising less than 3 volume percent hydrogen sulfide. The second hydrorefining stage is operated within the same range of conditions as the first stage hydrorefining. It should be noted, however, that the actual conditions used in each stage may be different within the general broad ranges. A sulfided conventional hydrorefining catalyst is present in the second hydrorefining stage. The catalyst may be maintained in a fixed bed, moving bed, ebullating bed, or fluid bed. The catalyst may be of the same type of catalyst used in the first stage or it may be a different conventional hydrorefining catalyst. The second stage hydrorefining reaction is conducted for a time sufficient to desulfurize the partially desulfurized naphtha to greater extent, that is, to achieve a total desulfurization level greater than about 99 weight percent relative to the naphtha feed sulfur of the first hydrorefining stage. The effluent of the second hydrorefining stage is passed via line 24 to a separation zone 26. The effluent of the second hydrorefining zone comprises the desulfurized normally liquid naphtha product and a gas comprising hydrogen, and a minor amount, for example, from about 0.001 to about 0.06 volume percent hydrogen sulfide. The gas is removed from separation zone 26 and recycled via line 28 to the sulfur-containing naphtha feed for introduction into the first hydrorefining stage. Optionally, the minor amount of hydrogen sulfide may be removed from the second stage gaseous effluent prior to passing the gaseous effluent to the first stage hydrorefining zone, although, that is not necessary. The desulfurized naphtha product is recovered via line 30. It is suitable as feed for a catalytic reforming process.

Figure 2:
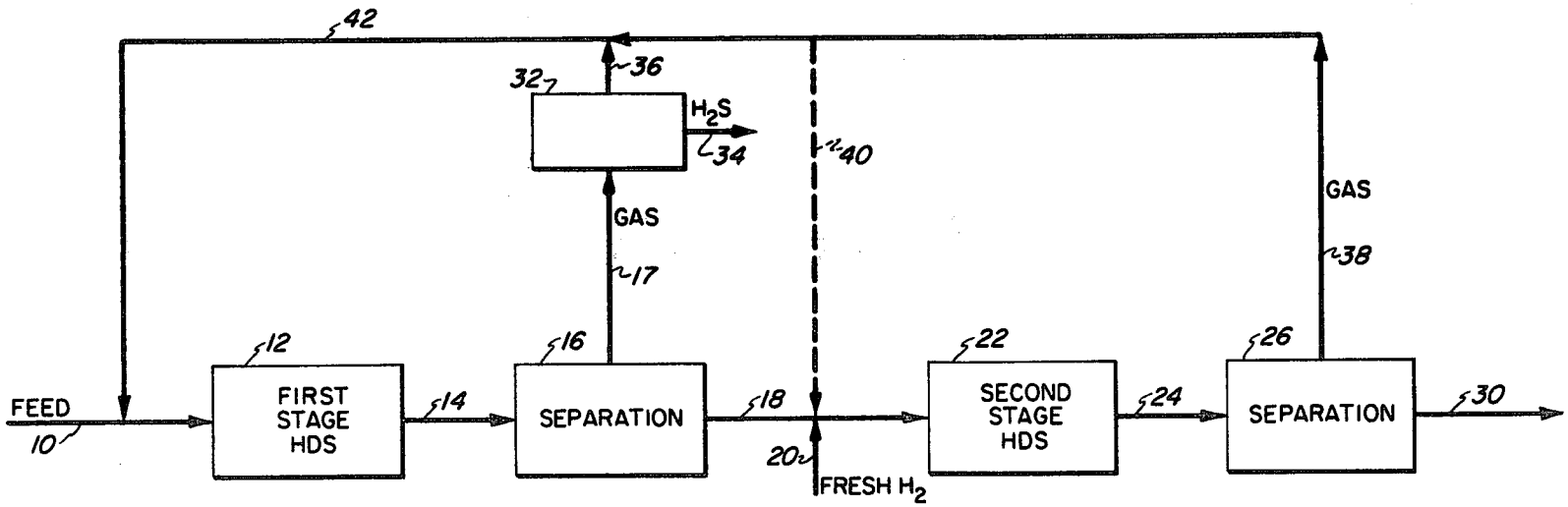
FIG. 2 is a schematic flow plan of another embodiment of the invention.

The FIG. 2 embodiment differs from the FIG. 1 embodiment as follows. The hydrogen-containing gas removed from separator 16 via line 17 is passed to separation zone 32 wherein hydrogen sulfide and other contaminants are removed via line 34. The cleaned hydrogen-containing gas is passed via line 36 into line 42 for recycle into the first hydrorefining stage. The gaseous effluent from separation zone 26 is removed by line 38 and split. One portion of the gas may be recycled via line 40 to the inlet of the second hydrorefining stage. Another portion of the gas is mixed with the cleaned gas recovered by line 36 and passed via line 42 into the first hydrorefining stage.

What is claimed is:

1. A naphtha hydrorefining process which comprises:

(a) contacting a feed consisting essentially of a sulfur-containing naphtha in a first hydrorefining stage with a hydrorefining catalyst and with a hydrogen-containing gas consisting essentially of a hydrogen-containing gas recycled from step (d) at hydrorefining conditions including a temperature ranging from about 500° to about 700° F., to produce a first hydrorefining stage effluent comprising a partially desulfurized normally liquid naphtha product and a gaseous product comprising hydrogen and hydrogen sulfide;

(b) separating at least a portion of the hydrogen sulfide from said first hydrorefining stage effluent;

(c) contacting at least a portion of the first hydrorefining stage effluent resulting from step (b) in a second hydrorefining stage at hydrorefining conditions with added fresh hydrogen in the presence of a sulfided hydrorefining catalyst to produce a second stage hydrorefining effluent comprising a normally liquid naphtha having a decreased sulfur content relative to said partially desulfurized naphtha and a hydrogen-containing gas comprising hydrogen sulfide, and (d) recycling at least a portion of the hydrogen-containing gas including said hydrogen sulfide of step (c) to said first hydrorefining stage.

2. The process of claim 1 wherein prior to recycling said portion of hydrogen-containing gas to said first hydrorefining stage, at least a portion of said hydrogen sulfide is separated therefrom.

3. The process of claim 1 wherein said naphtha in said first hydrorefining stage is partially desulfurized to a level ranging from about 90 to about 99.0 weight percent relative to the naphtha feed sulfur.

4. The process of claim 1 wherein the total desulfurization of said naphtha resulting from said second hydrorefining stage is greater than about 99 weight percent based on the naphtha feed sulfur to the first hydrorefining zone.

5. The process of claim 1 wherein said sulfur-containing naphtha feed of step (a) is an olefin-containing naphtha.

6. The process of claim 1 wherein said sulfur-containing naphtha feed of step (a) comprises a mixture of olefin-containing naphtha fractions.

7. The process of claim 1 wherein said sulfur-containing naphtha feed of step (a) comprises a mixture of at least one olefin-containing naphtha fraction and at least one non-olefinic naphtha fraction.

8. The process of claim 1 wherein a sulfur-containing naphtha is added to said first hydrorefining stage effluent resulting from step (b) prior to said contacting of step (c) in said second hydrorefining stage.

9. The process of claim 1 wherein the hydrorefining conditions in each of said first hydrorefining stage and said second hydrorefining stage include a pressure ranging from about 50 to about 2000 psig, and a temperature ranging from about 500° to about 700° F.

10. The process of claim 1 wherein said hydrorefining catalyst in said first hydrorefining stage is a sulfided catalyst.

11. The process of claim 1 wherein said hydrorefining catalyst in said first hydrorefining stage comprises at least one Group VIB metal component and at least one Group VIII non-noble metal component composited with a support.

12. The process of claim 1 wherein said sulfided hydrorefining catalyst in said second hydrorefining stage comprises at least one Group VIB metal component and at least one Group VIII non-noble metal component composited with a support.

13. A naphtha hydrorefining process which comprises:

(a) contacting a feed consisting essentially of a sulfur-containing olefinic naphtha in a first hydrorefining stage with a hydrorefining catalyst and with a hydrogen-containing gas consisting essentially of a hydrogen-containing gas recycled from step (d) at hydrorefining conditions including a temperature ranging from about 500° to about 700° F. and a pressure ranging from about 150 to about 800 psig to produce a first hydrorefining stage effluent comprising a partially desulfurized normally liquid naphtha, said partial desulfurization level ranging from about 90 to about 99 weight percent relative to the naphtha feed sulfur, and a gaseous product comprising hydrogen, hydrogen sulfide and $C_1$ and $C_3$ hydrocarbons;

(b) separating at least a portion of said hydrogen sulfide and said $C_1$ to $C_3$ hydrocarbons from said first hydrorefining stage effluent;

(c) contacting at least a portion of the effluent resulting from step (b) in a second hydrorefining stage with a sulfided hydrorefining catalyst and with added fresh hydrogen at hydrorefining conditions including a temperature ranging from about 500° to about 700° F. and a pressure ranging from about 150 to about 800 psig to produce a second stage hydrorefining effluent comprising normally liquid naphtha desulfurized to a level greater than about 99 weight percent relative to a naphtha feed sulfur of the first hydrorefining stage, and a hydrogen-containing gas comprising hydrogen sulfide, and (d) recycling at least a portion of the entire hydrogen-containing gas including said hydrogen sulfide resulting from step (c) to step (a).

* * * * *